US012709364B1

(12) United States Patent
Diserio et al.

(10) Patent No.: US 12,709,364 B1
(45) Date of Patent: Aug. 18, 2026

(54) MODULAR FLOATING DECK STRUCTURE

(71) Applicant: American Muscle Docks & Fabrication LLC, Wellsburg, WV (US)

(72) Inventors: Lucas Diserio, Wellsburg, WV (US); Paul Diserio, Wellsburg, WV (US); Marc Hannah, Wheeling, WV (US)

(73) Assignee: American Muscle Docks and Fabrication LLC, Wellsburg, WV (US)

( * ) Notice: Subject to any disclaimer, the term of this patent is extended or adjusted under 35 U.S.C. 154(b) by 337 days.

(21) Appl. No.: 18/417,736

(22) Filed: Jan. 19, 2024

Related U.S. Application Data

(60) Provisional application No. 63/480,751, filed on Jan. 20, 2023.

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS

| | | | | |
|---|---|---|---|---|
| 4,280,429 | A * | 7/1981 | Wells | B63C 1/02 114/45 |
| 7,071,258 | B1 | 7/2006 | Jang et al. | |
| 7,464,659 | B2 * | 12/2008 | Lemonides | B63B 21/04 114/263 |
| 8,142,754 | B2 | 3/2012 | Lanzara et al. | |
| 9,388,048 | B1 | 7/2016 | Zhou et al. | |
| 9,732,788 | B2 * | 8/2017 | Vankoughnett | B63B 35/34 |
| 9,957,024 | B2 * | 5/2018 | Choi | B63C 3/12 |
| 10,000,384 | B2 | 6/2018 | Jang et al. | |
| 10,017,230 | B1 | 7/2018 | Diserio | |
| 10,717,653 | B2 | 7/2020 | Womble et al. | |
| 11,649,600 | B2 * | 5/2023 | Golden | B63B 35/34 405/227 |
| 2016/0145822 | A1 * | 5/2016 | Gerst | B63C 1/02 114/220 |
| 2018/0099728 | A1 * | 4/2018 | Despres | B63C 1/02 |

FOREIGN PATENT DOCUMENTS

| | | | | |
|---|---|---|---|---|
| CN | 111484663 | A * | 8/2020 | C08L 27/06 |
| CN | 120057183 | A * | 5/2025 | B63B 17/00 |
| GB | 600455 | A * | 4/1948 | B63B 71/00 |
| JP | H03119244 | A * | 5/1991 | |

* cited by examiner

*Primary Examiner* — Magdalena Topolski
(74) *Attorney, Agent, or Firm* — Alvin T. Rockhill

(57) ABSTRACT

It has been found that there are a multitude of significant advantages associated with modular floating deck structures which are comprised of at least one deck section which includes a frame having float drums attached to the bottom side thereof and a deck which is attached to the top side thereof, wherein the frame is comprised of structural boards which are comprised of certain fiber reinforced plastics. Such modular floating dock structures are strong, lightweight, highly durable, extremely resistant to corrosion and decay, and can be easily assembled from prefabricated sections. They also have the ability to rise and fall to meet changes in water level. They are superior to conventional floating dock structures in that they are highly resistant to corrosion and decay and accordingly provide greatly improved reliability and an extended service life.

20 Claims, 9 Drawing Sheets

MODULAR FLOATING DECK STRUCTURE

This application claims benefit of United States Provisional Patent Application Ser. No. 63/480,751, filed on Jan. 20, 2023. The teachings of U.S. Provisional Patent Application Ser. No. 63/480,751 are incorporated herein by reference in their entirety.

FIELD OF THE INVENTION

This invention relates to a modular floating dock structure which can be used on any type of body of water, including ponds, lakes, rivers, streams, or in the ocean. Such floating docks include floating drums and have the ability to rise and fall to meet changes in water level. They are of particular benefit when used in bodies of water where the water level has a tendency to change in height, such as with the tides or after heavy rainfalls or during periods of drought. The floating dock structures of this invention can be used as boat docks, fishing docks, swim platforms, or the like. They and are superior to conventional floating dock structures in that they are highly resistant to corrosion and decay and accordingly provide greatly improved reliability and an extended service life.

BACKGROUND OF THE INVENTION

Installing docks, piers, swim platforms, and gang planks is often a complicated, time consuming, and messy process. For instance, building these structures typically requires multiple persons using ratchets, clamps, chains, and various other tools in an effort to obtain a structure that is properly aligned and level. Some structural designs require the builder to enter the water in which the structure will stand. It is not uncommon for these workers to become completely or partially submerged in the water. In some cases, valuable equipment is irretrievably lost in the water while installing a dock, pier, swim platform, gang plank, or other similar structures.

Because gang planks, piers and docks are generally built to facilitate the transportation of goods and persons over water or wetlands, it is critical to avoid mistakes during installation because mistakes can cause individuals or valuables to fall and/or become lost. In other words, mistakes during installation which cause the structure to be uneven, unstable, or otherwise unsound can be both disastrous and costly. Correcting such problems associated with improper installation can also be difficult, time consuming and expensive.

Appropriately, docks, planks, swim platforms, or other similar structures must be reliable, durable, safe, mobile, and preferably aesthetically pleasing. Reliability is especially important to weak swimmers who rely upon such structures to keep them from falling into water and, in a terrible scenario, drowning. Such structures are also frequently relied upon as a device for leaving water and again must be reliable to protect people from drowning. It is also critical that such structures be durable against damage from repetitive and continuous use, and damage from the elements. These structures are frequently kept outdoors over extended periods of time and accordingly can be exposed to harsh and changing weather conditions, including intense ultra-violet light exposure, high temperatures, and extreme cold.

Deterioration occurs more rapidly when docks, piers, swim platforms and the like are held underwater because they are more susceptible to widespread invasion by aquatic life, damage from debris, and corrosion from prolonged exposure to water (i.e. rust). Therefore, it is highly desirable for docks, piers, and swim platforms to have the ability to rise and fall to meet changes in water level so that these structures are not held under water at periods of time when the water level would be higher than the top of a fixed structure.

It can be necessary to remove docks, piers, swim platforms, and gang planks in order to protect them from seasonal changes (i.e. freezing water and moving ice). It may also be desirable to remove or disassemble any of these structures for cleaning, repair, or during periods of non-use. For this reason, it is advantageous for such structures to be capable of being disassembled easily and in some cases modified with minimal effort. Furthermore, it is advantageous that such structures have the ability to stack or be compiled for compact storage. These features improve the overall mobility of a given structure, and are therefore desirable to consumers.

Individuals may require multiple uniquely sized docks, piers, swim platforms, or gang planks in order to accommodate variously sized water crafts, multiple water crafts, or to fit around certain objects (i.e. large stones, fallen trees, and man-made articles). Today most of these types of structures cannot be modified with ease, or they are capable of only limited modifications.

There is a continuing effort to make improvements upon existing designs for docks, piers, planks, platforms and other similar structures. In particular, there is a need for structures which can be transported as a kit of component parts that can be easily constructed into customized configurations. It would be of added benefit if such a structure, such as a dock, pier, gang plank, swim platform, or the like, could be assembled into the desired configuration by a single person without needing the assistance of others.

SUMMARY OF THE INVENTION

This invention relates to an improved modular floating dock structure which is strong, light-weight, highly durable, extremely resistant to corrosion and decay, and which can be easily assembled from prefabricated sections. This floating dock can be used on ponds, lakes, rivers, or in the ocean. The floating docks of this invention include floating drums and have the ability to rise and fall to meet changes in water level. They are of particular benefit when used in bodies of water where the water level has a tendency to change in height, such as with the tides or after heavy rainfalls or during periods of drought. Such floating docks can be used as boat docks, fishing docks, swim platform, or the like. They and are superior to conventional floating dock structures in that they highly resistant to corrosion and decay and accordingly provide greatly improved reliability and an extended service life.

The floating docks of this invention differ from conventional floating docks in that they have frames which are comprised of a fiber reinforced plastic, such as fiberglass reinforced polyvinyl chloride. Optionally, the deck structures of this invention also have decks which are comprised of plastic, such as polyethylene.

The subject invention more specifically relates to a modular floating deck structure which is comprised of at least one deck section which includes a frame having float drums attached to the bottom side thereof and a deck which is attached to the top side thereof, wherein the frame is comprised of structural boards which are comprised of a fiberglass reinforced plastic, and wherein the structural boards are affixed together with metal hardware which is adapted to maintain the frame in a desired orientation.

BRIEF DESCRIPTIONS OF THE DRAWINGS

DETAILED DESCRIPTIONS OF THE INVENTION

Figure 1:
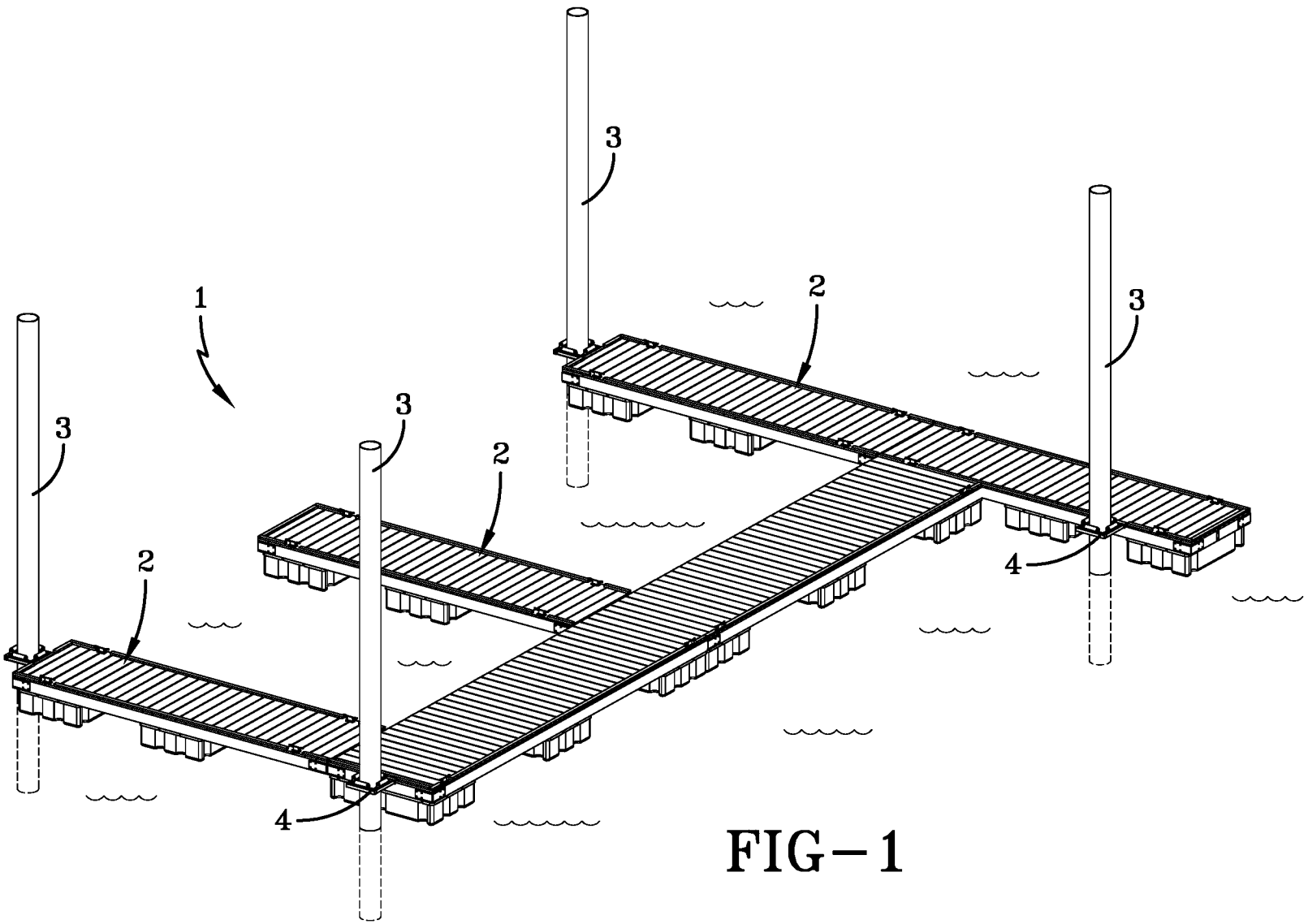
FIG. 1 illustrates such a dock configuration which is comprised of multiple modular deck sections which are connected together to made the dock configuration (deck structures).

The modular floating dock structures of this invention are characterized by having frames which are comprised of a fiber reinforced plastic. A wide variety of fiber reinforced plastics can be used. The plastic utilized will typically be a thermoplastic material, such as an aromatic vinyl-based resin, a rubber-modified aromatic vinyl-based resin, a polyphenylene ether based resin, a polycarbonate based resin, a polyester based resin, a methacrylate based resin, a polyarylene sulfide based resin, a polyamide based resin, a polyvinyl chloride based resin, a polyolefin based resin, a combination of such resins. For example, the fiber reinforced plastic can be fiber reinforced polyethylene, fiber reinforced polypropylene, fiber reinforced high impact polystyrene, fiber reinforced nylon, fiber reinforced polyester, fiber filled polycarbonate, or fiber reinforced polyvinyl chloride. The fiber reinforced polyesters that can be used are typically polyethylene terephthalate or polyethylene naphthalate. It is normally preferred to use a fiber filler polyvinyl chloride to attain needed performance characteristics at a reasonable cost.

The fiber utilized in the fiber filled plastic (fiber-reinforced plastic) can be glass fibers and/or carbon fibers. Because glass fiber itself is sometimes referred to as "fiberglass", the composite is also called fiberglass-reinforced plastic (FRP), glass-reinforced plastic (GRP), or glass-fiber reinforced plastic (GFRP). In any event, the plastic and the fibers which are used work in conjunction with each other to attain physical characteristics which are better than can be attained by using either material individually. For example, plastics are typically strong in compressive loading and relatively weak in tensile strength with glass fibers and carbon fibers are very strong in tension but are inferior in resisting compression. By combining the two materials, glass reinforced plastic exhibits well under both compression and tensile forces. The two materials can be used uniformly or the fibers can be placed in those portions of the deck frame that will experience the highest tensile loads. In most cases, the fibers will be distributed in a relatively uniform manner throughout the frame of the deck. The diameter of the filaments, and the number of filaments in a roving, conventionally determine its weight, which is expressed as: (1) yield, or yards per pound (the number of yards of fiber in one pound of material) or (2) tex, grams per km (how many grams per km of roving weight). Normally, the yield of the filaments used in the fiber reinforced plastics of this invention will be within the range of 200 to 800, such as about 225 yield, 450 yield, or 675 yield, and the tex of the filaments will be within the range of 700 tex to 2500 tex, such as about 750 tex, 1100 tex, or 2200 tex. The glass fiber will typically have an average diameter which is within the range of about 10 μm to 30 μm and will more typically have an average diameter which is within the range of 15 μm to 20 μm.

The glass fiber used in the practice of this invention will typically be E-glass which is an alumino-borosilicate glass which contains less than 1 weight percent alkali oxides. Other types of glass fibers that can optionally be used include A-glass (alkali-lime glass with little or no boron oxide), E-CR-glass (electrical/chemical resistance; alumino-lime silicate with less than 1 weight percent alkali oxides, with high acid resistance), C-glass (alkali-lime glass with a high boron oxide content), R-glass (alumino silicate glass without MgO and), and S-glass (alumino silicate glass without CaO but with high MgO content with high tensile strength). R-glass offers excellent mechanical characteristics as reinforcement and S-glass offers extremely high tensile strength. Accordingly, in one embodiment of this invention the fiber reinforced plastic will contain from 30 weight percent to 70 weight percent R-glass and from 30 weight percent to 70 weight percent S-glass, based upon the total weight of glass fibers in the glass reinforced plastic. Such composites with typically contain from 40 weight percent to 60 weight percent R-glass and from 40 weight percent to 60 weight percent S-glass, based upon the total weight of glass fibers in the glass reinforced plastic.

The glass fiber or the carbon fiber will typically be incorporated into the plastic at a level which is within the range of about 1 part by weight to 50 parts by weight, based upon the total weight of the fiber reinforced plastic. The fiber will normally be incorporated into the plastic at a level which is within the range of about 5 part by weight to 45 parts by weight and will more typically be incorporated into the plastic at a level which is within the range of about 10 part by weight to 35 parts by weight, based upon the total weight of the fiber reinforced plastic.

The fiber reinforced plastic composition will normally further include various additives, such as antioxidant, a heat stabilizer, a dispersant, a compatibilizer, a pigment, and combinations thereof. To improve the ability of the fiber reinforced plastic to retain screws it can also include graphene. The graphene is typically incorporated into the fiber reinforced plastic composition at a level which is within the range of about 0.001 weight percent to about 5 weight percent, based upon the total weight of the fiber reinforced plastic composition. The graphene will more typically be incorporated into the fiber reinforced plastic composition at a level which is within the range of 0.002 weight percent to 1 weight percent and which will generally be included at a level which is within the range of 0.003 weight percent to 0.5 weight percent. It is generally preferred for the graphene to be included in the fiber reinforced plastic composition at a level which is within the range of 0.005 weight percent to 0.1 weight percent. It is generally more preferred for the graphene to be included in the fiber reinforced plastic composition at a level which is within the range of 0.01 weight percent to 0.05 weight percent. It is generally most preferred for the graphene to be included in the fiber reinforced plastic composition at a level which is within the range of 0.015 weight percent to 0.025 weight percent.

The graphene used in the practice of this invention can have zig-zag, armchair, K-region, gulf, bay, cove, and fjord edge topologies. Typically, at least 50 percent, 60 percent, 70 percent, or 80 percent of the carbon-carbon bonds on the edges of the graphene structure will be in the zig-zag configuration, the armchair configuration, or the bay configuration. In many cases, at least 40 percent, 50 percent, or 60 percent of the carbon-carbon bonds on the edges of the graphene structure will be in the zig-zag configuration. In one embodiment at least 40 percent, 50 percent, or 60 percent of the carbon-carbon bonds on the edges of the graphene structure will be in the armchair configuration. In another embodiment at least 40 percent, 50 percent, or 60 percent of the carbon-carbon bonds on the edges of the graphene structure will be in the bay configuration. Typically, less than 40 percent of the carbon-carbon bonds on the edges of the graphene structure will be in the cove configuration and more typically less than 30 percent of the carbon-carbon bonds on the edges of the graphene structure will be in the cove configuration. In another embodiment less than 40 percent of the carbon-carbon bonds on the edges of the graphene structure will be in the cove configuration and less than 30 percent or more typically less than 20 percent of the carbon-carbon bonds on the edges of the graphene structure will be in the fjord configuration.

The graphene used in the practice of this invention will typically be single-layered graphene which is a one-atom-thick substantially planar sheet of bonded carbon atoms that are densely packed in a honeycomb crystal lattice. As used herein, the term graphene is used to generally describe thinly-layered structures including one or more single-layered graphene sheets that are stacked together. Exemplary graphene fillers that can be used include graphene, nanolayered graphene (NLG), few layered graphene (FLG), graphite nanoplatelets (GNP), other nanolayered fillers, and the like. For reference, nanolayered graphene (NLG) is graphene that includes up to ten layers of single layer graphene, few layer graphene (FLG) is graphene that includes two to three layers of single layer graphene, and graphite nanoplatelet (GNP) is graphene that includes stacked layers of graphene. GNP is generally between about 1 and about 15 nanometers thick. In general, each of the exemplary graphene fillers has a platelet shape. The platelet shape is also described as a substantially planar shape. In some embodiments the graphene has a structure that looks like wrinkled paper. The platelet shape can be contrasted, for example, with the tubular shape of carbon nanotubes and fullerenes.

The graphene used in the practice of this invention is exfoliated into nano-scaled graphene plate (NGP) material that is essentially comprised of individual single sheets of graphene or a plurality of sheets of graphite planes. Each graphite plane, also referred to as a graphene plane or basal plane, is comprised of a two-dimensional hexagonal structure of carbon atoms. Each plane has a length and a width parallel to the graphite plane and a thickness orthogonal to the graphite plane characterized in that at least one of the values of length, width, and thickness is 100 nanometers (nm) or smaller. Preferably, all length, width and thickness values are smaller than 100 nm. This NGP material can be produced by a method described in U.S. Pat. No. 7,071,258 which comprises the steps of: (a) carbonization or graphitization to produce a polymeric carbon, (b) exfoliation or expansion of graphite crystallites in the polymeric carbon to delaminate or separate graphene planes, and (c) mechanical attrition of the exfoliated structure to nanometer-scaled plates. The teachings of U.S. Pat. No. 7,071,258 are incorporated herein by reference for the purpose of describing graphene that can be utilized in the practice of this invention and methods for manufacturing such graphene. In the practice of this invention it is preferred for the graphene to be comprised of individual single sheets of graphene (single graphene planes or single basal planes).

U.S. Pat. No. 10,717,653 reveals a method for manufacturing graphene. This method comprises: (a) applying a vacuum to a furnace, the inside of the furnace comprising: (A) an oxygen scavenger; and, (B) a growth sample, the growth sample, comprising: a carbon-containing metal and a substrate, wherein the carbon-containing metal is in the form of a plurality of seeds that are in contact with the substrate; (b) introducing a hydrogen-containing gas to the furnace; (c) heating the inside of the furnace to a temperature and for a time sufficient to initiate graphene formation on the carbon-containing metal; (d) cooling the furnace; and (e) removing the seeds from the substrate.

U.S. Pat. No. 8,142,754 discloses a method for the production of graphene comprising: spacing a silicon wafer from a silicon carbide wafer in a pressure vessel; reducing the pressure in the vessel to vacuum; heating the silicon wafer to a first temperature to evaporate silicon from its opposing surface; while simultaneously, heating the silicon carbide wafer to a second temperature to anneal the silicon carbide wafer, wherein the first temperature is 1200° C. and the second temperature is at least about 1500° C. U.S. Pat. No. 9,388,048 describes a method for synthesizing monolayer graphene by chemical vapor deposition and U.S. Pat. No. 10,000,384 discloses a method for the laser direct synthesis of graphene. The teachings of U.S. Pat. Nos. 8,142,754, 9,388,048, and 10,000,384 are incorporated herein by reference for the purpose of describing techniques for manufacturing graphene.

The decks utilized in the docks of this invention can also be comprised of a plastic to improve durability and to eliminate decay and deterioration over time. The use of plastic decks can also reduce the overall weight of the deck structure which is advantageous during transportation and installation. Reduced weight also reduces the load that is applied to the frame of the floating deck structure. Any of the fiber reinforced plastics described herein for used in making the frame can also be used in making the deck. However, to minimize cost the deck will normally be comprised of a plastic that is not fiber reinforced. For instance, the deck can be made of polyethylene with high density polyethylene being preferred.

Figure 2:
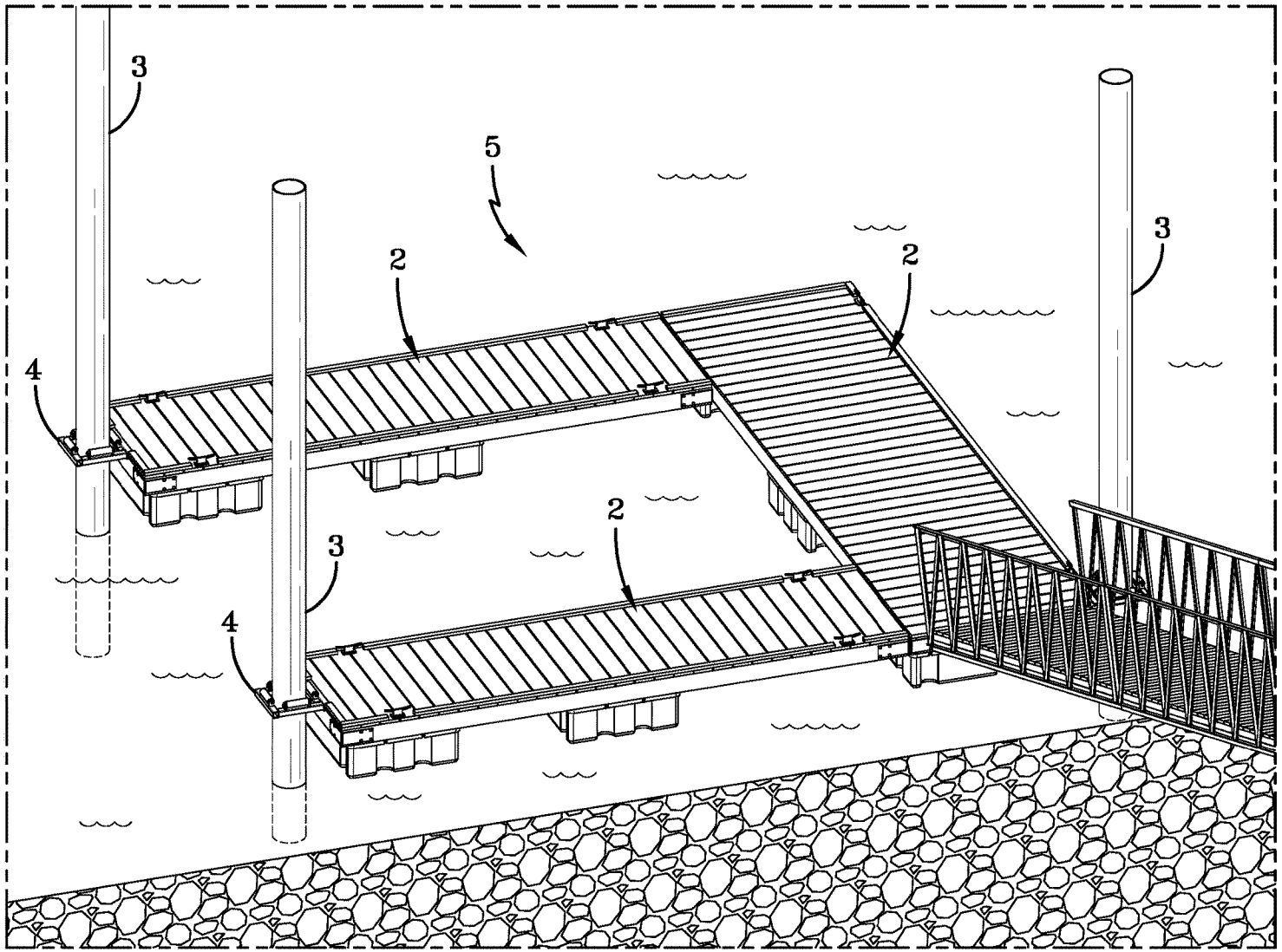
FIG. 2 illustrates a second dock configuration which is also comprised of deck sections, mooring poles, moorings, and a gangplank.

Dock assemblies of the type disclosed in U.S. Pat. No. 10,017,230 B1 can be made in accordance with the teachings of this invention. The teachings of U.S. Pat. No. 10,017,230 B1 are incorporated herein by reference. Docks having any desired configuration can be made with the modular floating deck sections of this invention. FIG. 1 illustrates such a dock configuration 1 which is comprised of multiple modular deck sections 2 which are connected together to make the dock configuration (deck structures) 2. The deck structure 1 is held in place in the water to prevent the dock from floating away with mooring poles 3 through moorings 4 which are designed to allow the deck to move up or down with the level of the water. FIG. 2 illustrates a different dock configuration 5 which is also comprised of deck sections 2, mooring poles 3, and moorings 4. A gangplank 6 is attached to the floating deck structure 5 to allow for access to the deck structure 5 at higher and lower water levels.

Figure 3:
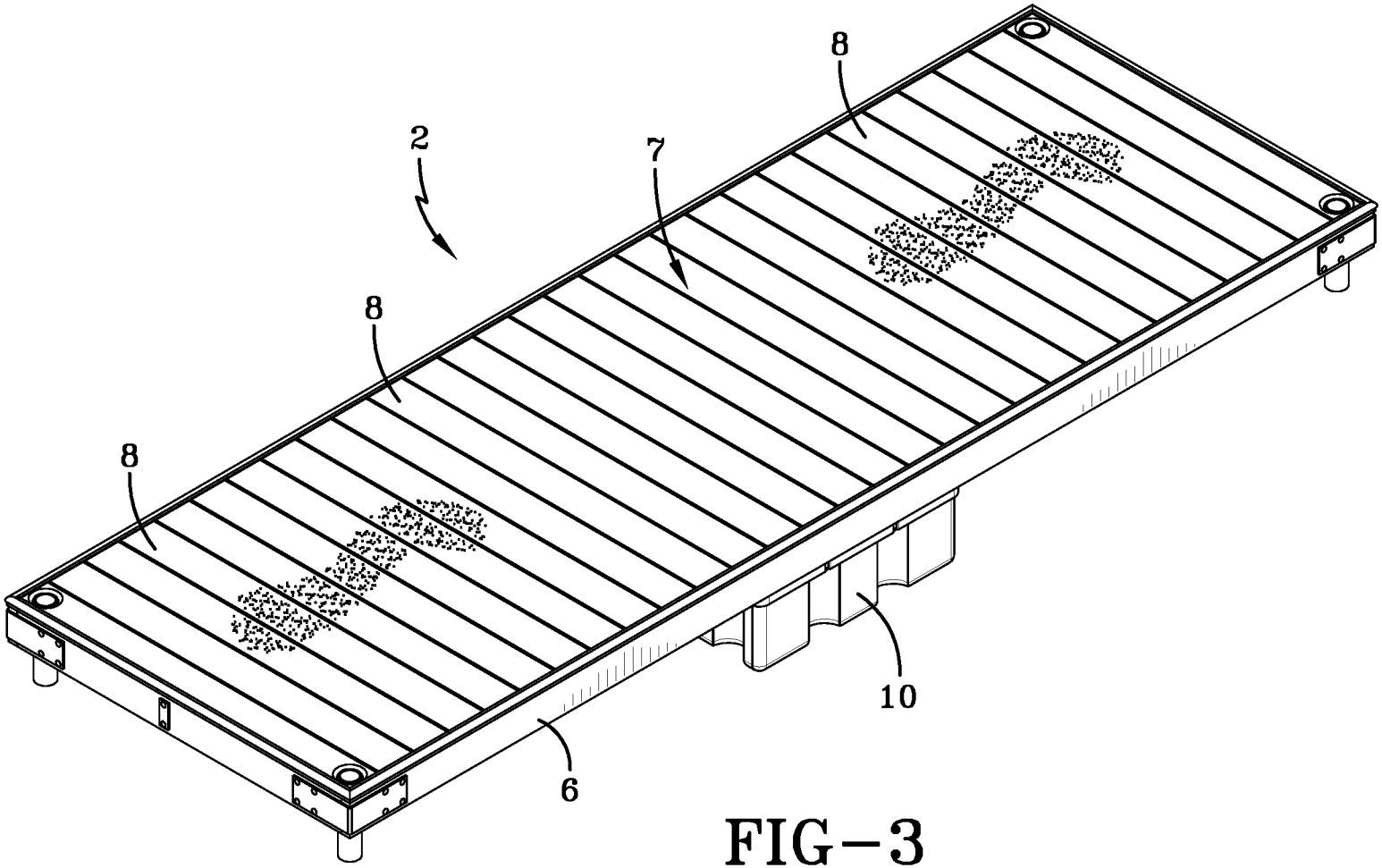
FIG. 3 illustrates a floating dock section having a frame and a deck which is comprised of a plurality of deck planks with the frame being attached to float. This frame also has mooring connectors which are comprised of a cylindrical pipe which is affixed to the inside of an angle iron.

FIG. 3 illustrates a floating dock section 2 having a frame 6 and a deck 7 which is comprised of a plurality of deck planks 8. Such floating dock sections 2 are typically about 20 feet long.

Figure 4:
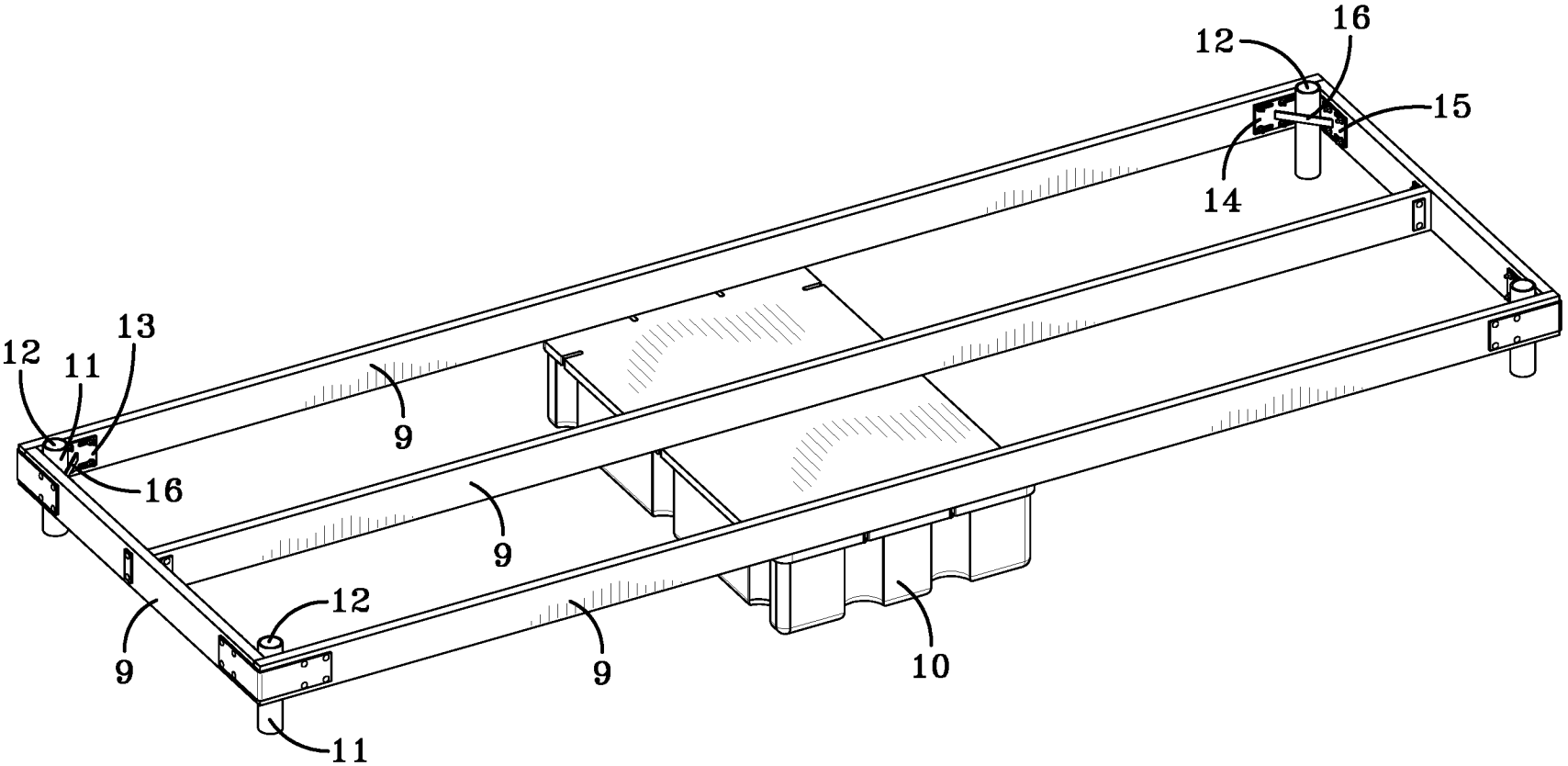
FIG. 4 illustrates the frame of a dock section which is comprised of structural boards, metal hardware, and a float drum.

FIG. 4 illustrates a typically frame 6 which is comprised of structural boards 9 which are comprised of a fiber reinforced plastic. This frame 6 is attached to float drums 10 to allow for flotation in water. This frame also has wherein mooring connectors 11 which are comprised of a cylindrical pipe 12 which is affixed to the inside of an angle iron 13. The angle irons 13 have a first inside face 14 and a second inside face 15 with the cylindrical pipe 12 being secured to the angle irons 13 with a support bar 16 which extends from the first inside face 14 to the second inside face 15 of the angle iron 13.

Figure 5:
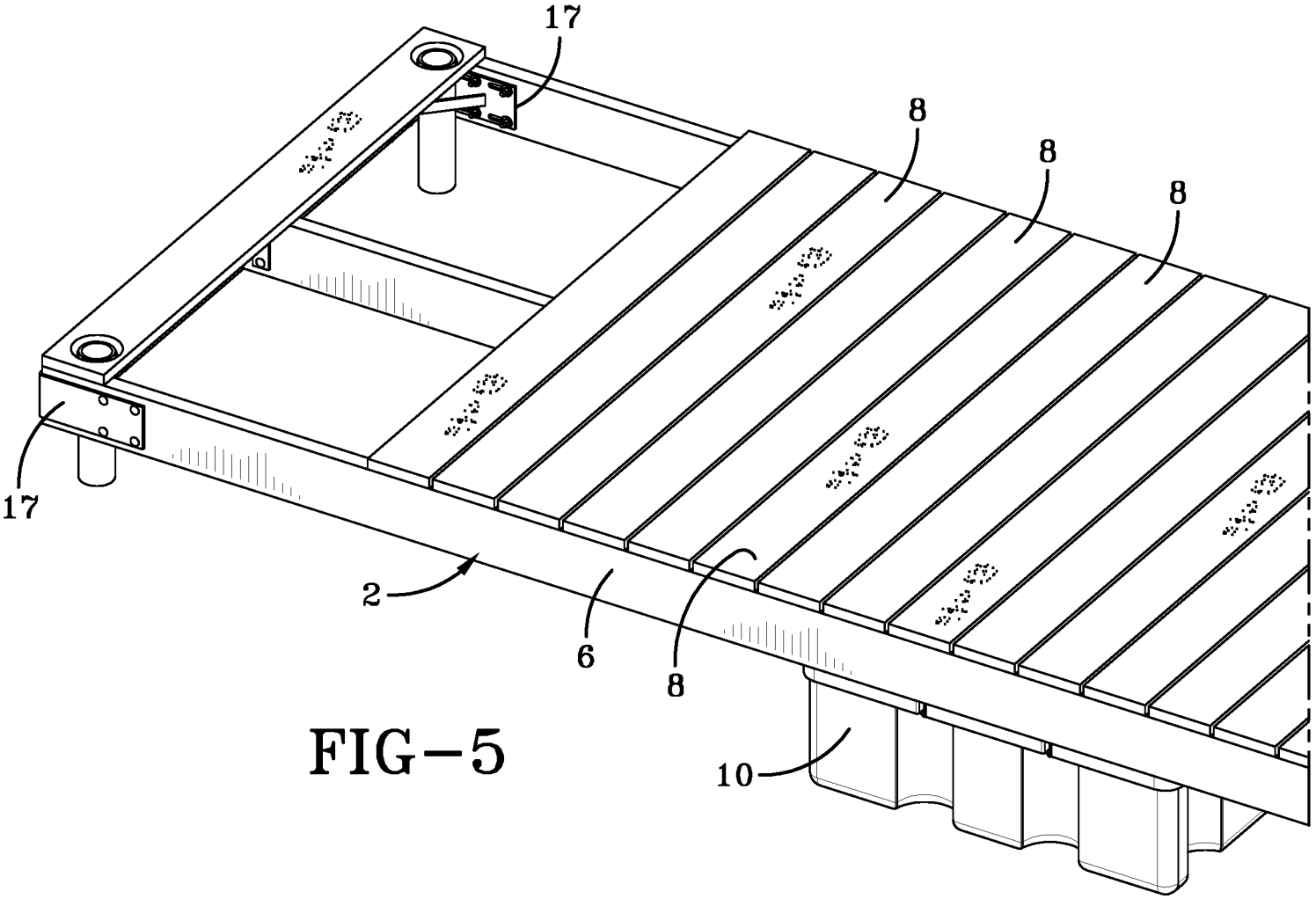
FIG. 5 is a top view of a dock section which is partially covered with deck planks. This dock section is kept structurally square with angle irons.

FIG. 5 is a top view of a deck section 2 which is partially covered with deck planks 8. As can be seen, this deck section 2 is keeps structurally square with angle irons 17.

Figure 6:
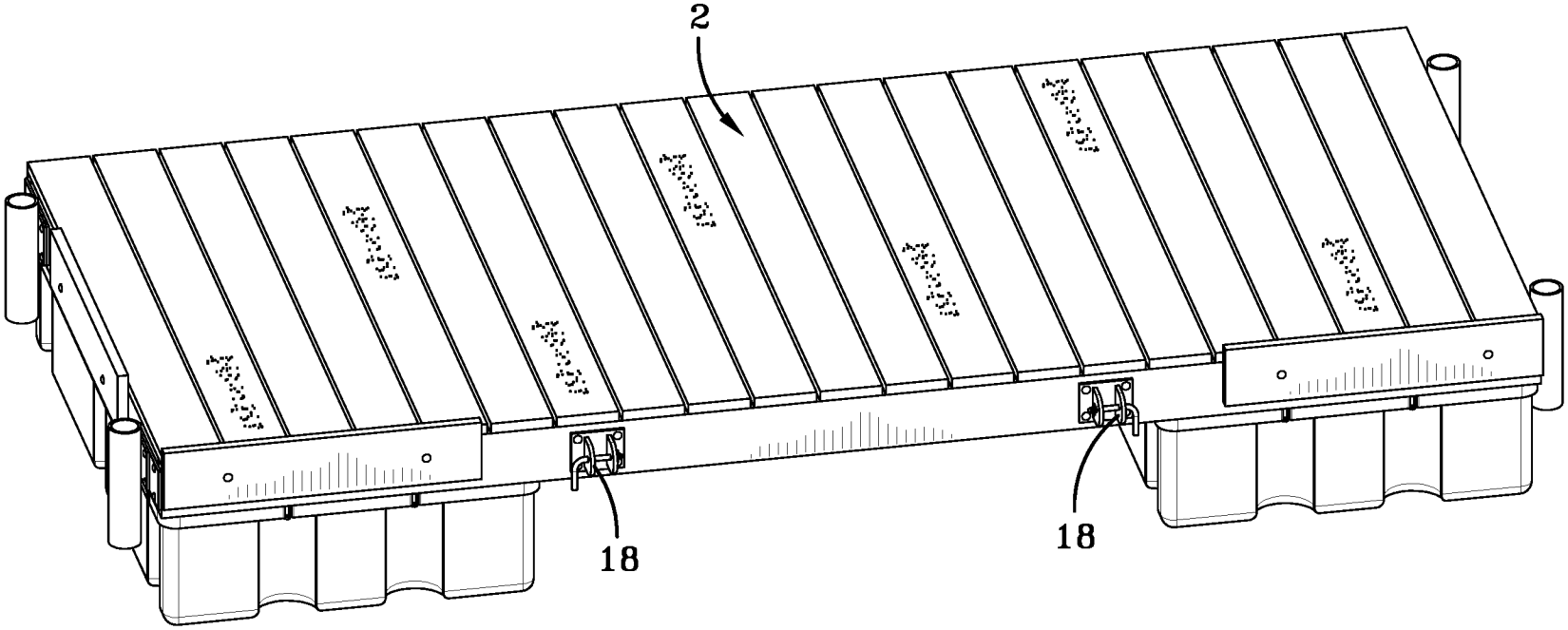
FIG. 6 depicts a dock section having male connectors which are adapted for connection to female connectors on another dock section.
Figure 7:
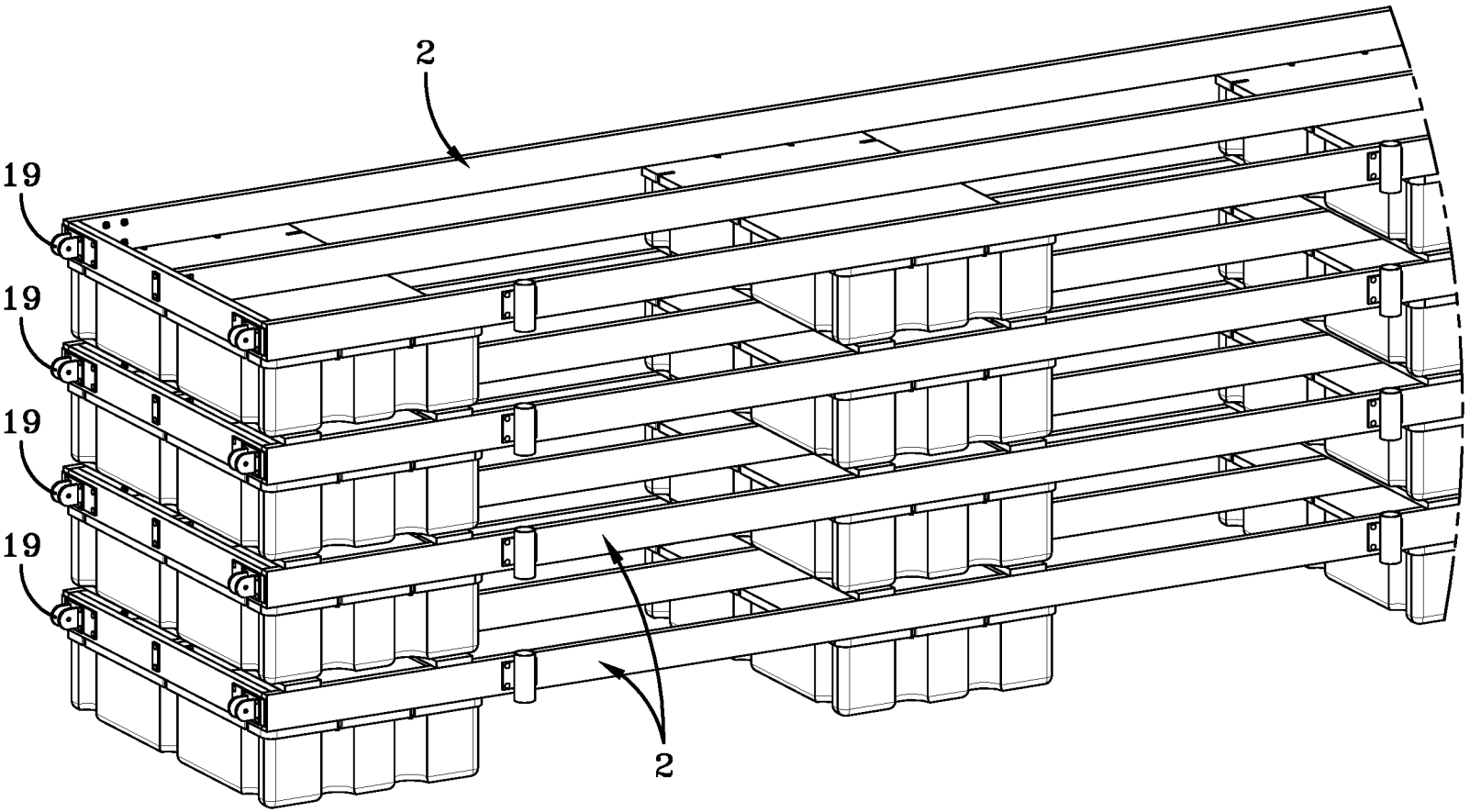
FIG. 7 depicts a dock section having female connectors which are adapted for connection to male connectors on another dock section.

FIG. 6 depicts a deck section 2 having male connectors 18 which are adapted for connection to female connectors 19 on another deck section as illustrated in FIG. 7. It should be noted that FIG. 7 depicts dock sections 2 which are stacked on top of each other.

Figure 8:
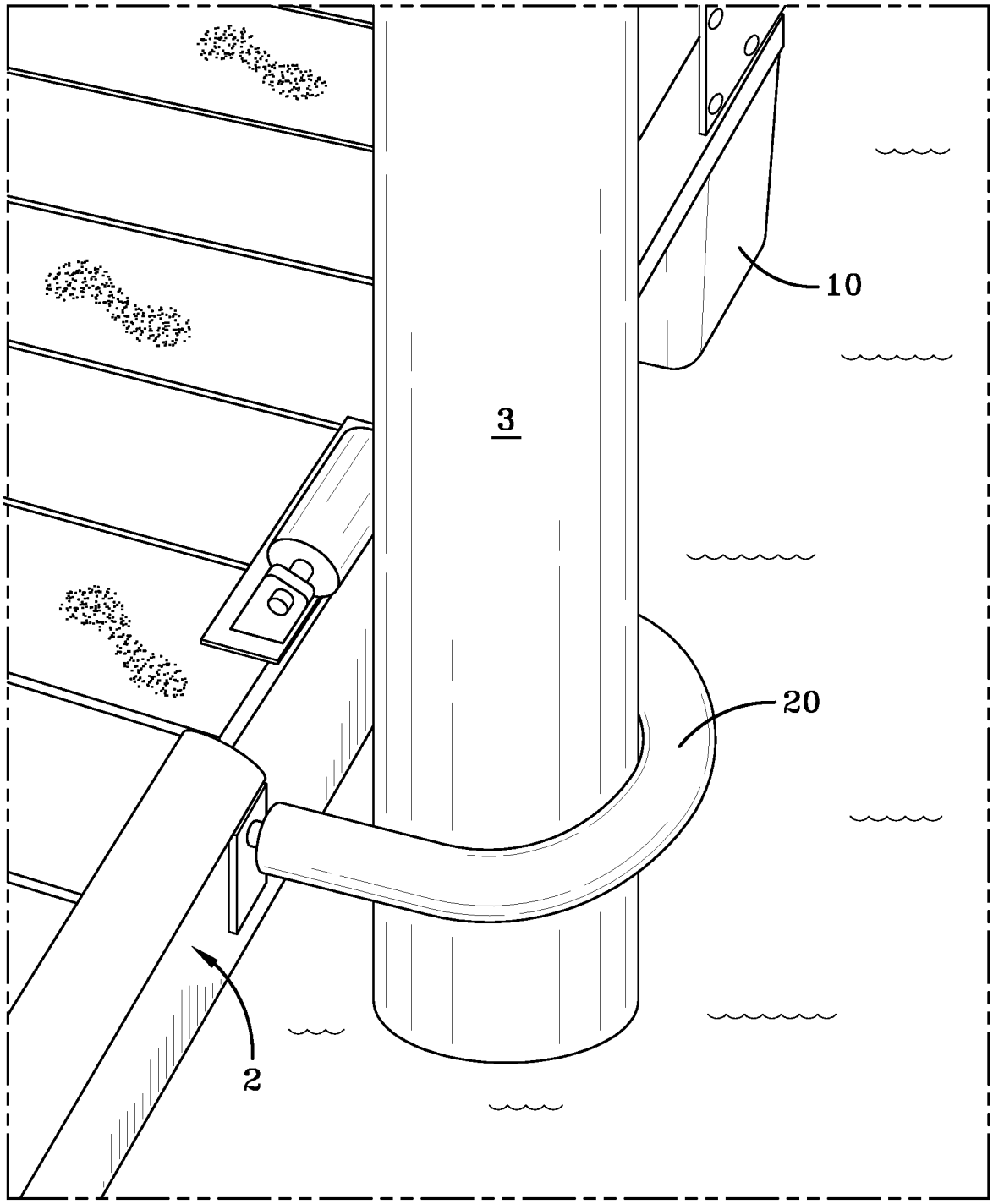
FIG. 8 illustrates an embodiment of this invention wherein a different type of mooring connector is affixed to the dock section.

FIG. 8 illustrates an embodiment of this invention wherein a different type of mooring connector 20 is affixed to the dock section 2. This mooring connector 20 is a U-pipe that is adapted to receive a mooring pole 3.

Figure 9:
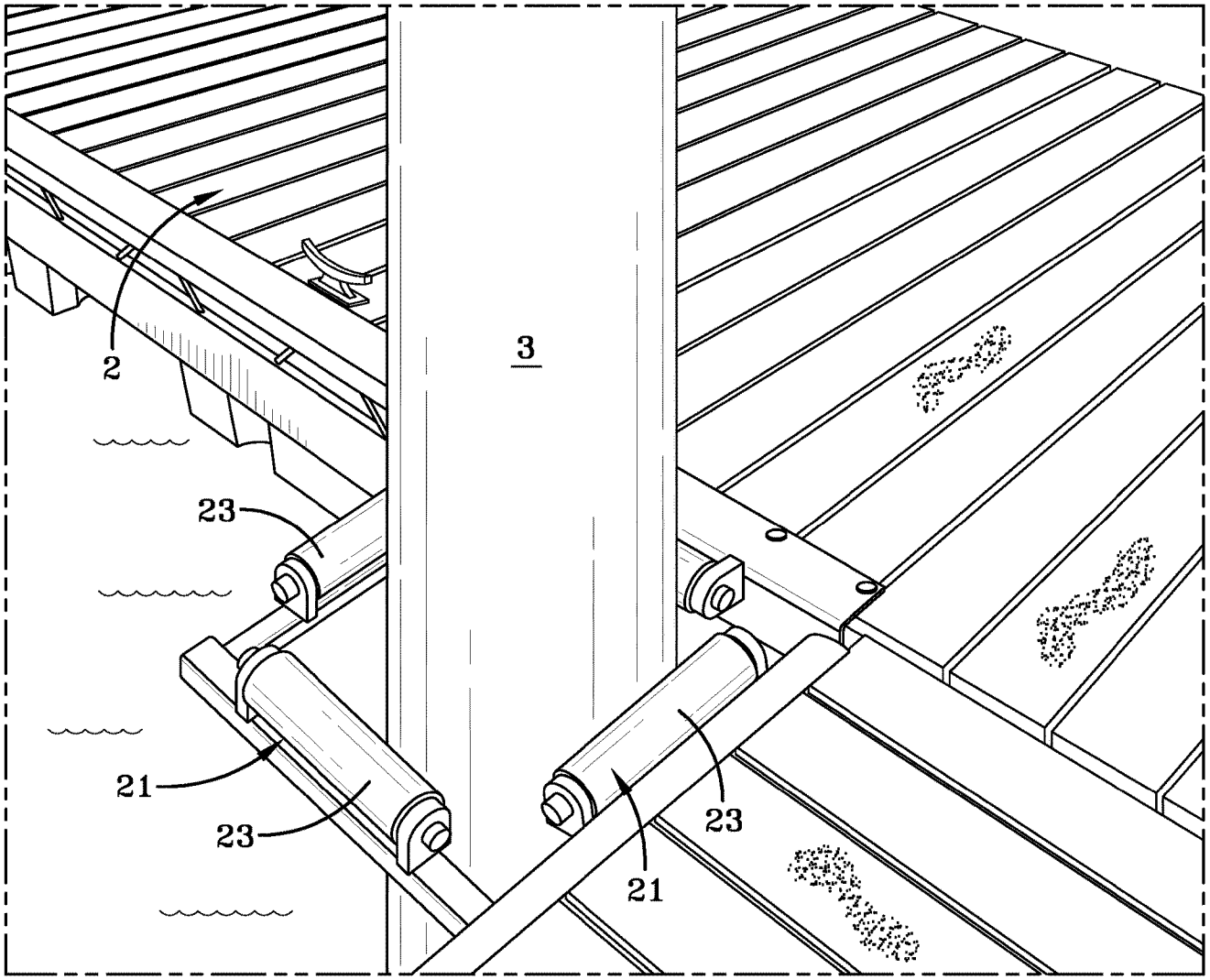
FIG. 9 illustrates still another embodiment of this invention wherein a different type of mooring connector is affixed to the dock section.

FIG. 9 illustrates still another embodiment of this invention wherein a different type of mooring connector 21 is affixed to the dock section 2. This mooring connector 21 is comprised of a plurality of rollers 23 which are adapted to receiving a mooring pole 3.

While certain representative embodiments and details have been shown for the purpose of illustrating the subject invention, it will be apparent to those skilled in this art that various changes and modifications can be made therein without departing from the scope of the subject invention.

What is claimed is:

1. A modular floating deck structure which is comprised of at least one deck section which includes a frame having float drums attached to the bottom side thereof and a deck which is attached to the top side thereof, wherein the frame is comprised of structural boards which are comprised of a fiber reinforced plastic, wherein the structural boards are affixed together with metal hardware which is adapted to maintain the frame in a desired orientation, wherein the deck section includes a mooring connector, and wherein the mooring connector is an angle iron having a cylindrical pipe which is affixed to the inside angle thereof.

2. The modular floating deck structure as specified in claim 1 wherein the fiber reinforced plastic is fiber reinforced polyvinyl chloride.

3. The modular floating deck structure as specified in claim 2 wherein the fiber reinforced polyvinyl chloride is fiberglass reinforced polyvinyl chloride.

4. The modular floating deck structure as specified in claim 1 wherein the metal hardware is screwed onto the structural boards.

5. The modular floating deck structure as specified in claim 1 wherein the deck section includes a male section connector and a female section connector.

6. The modular floating deck structure as specified in claim 1 wherein the angle iron has a first inside face and a second inside face, and wherein the cylindrical pipe is secured to the angle iron with a support bar which extends from the first inside face to the second inside face of the angle iron.

7. The modular floating deck structure as specified in claim 1 wherein the deck is comprised of a plurality of plastic boards which are comprised of polyethylene.

8. The modular floating deck structure as specified in claim 1 wherein the reinforced plastic is carbon fiber reinforced polyvinyl chloride.

9. The modular floating deck structure as specified in claim 8 wherein the fiber reinforced polyvinyl chloride is further comprised of graphene.

10. A modular floating deck structure which is comprised of at least one deck section which includes a frame having float drums attached to the bottom side thereof and a deck which is attached to the top side thereof, wherein the frame is comprised of structural boards which are comprised of a fiber reinforced plastic, and wherein the structural boards are affixed together with metal hardware which is adapted to maintain the frame in a desired orientation, wherein the reinforced plastic is carbon fiber reinforced polyvinyl chloride, wherein the fiber reinforced polyvinyl chloride is further comprised of graphene, and wherein at least 50 percent of the carbon-carbon bonds on the edges of the graphene structure are in the zig-zag configuration, the armchair configuration, or the bay configuration.

11. The modular floating deck structure as specified in claim 10 wherein the metal hardware includes angle irons which maintain structural boards at a 90° angle to each other.

12. The modular floating deck structure as specified in claim 10 wherein the deck section includes a mooring connector.

13. The modular floating deck structure as specified in claim 12 wherein the mooring connector is a U-pipe that is adapted to receive a mooring pole.

14. The modular floating deck structure as specified in claim 12 wherein the mooring connector is comprised of a plurality of rollers which are adapted to receiving a mooring pole.

15. The modular floating deck structure as specified in claim 10 wherein at least 40 percent of the carbon-carbon bonds on the edges of the graphene structure are in the zig-zag configuration.

16. The modular floating deck structure as specified in claim 10 wherein at least 40 percent of the carbon-carbon bonds on the edges of the graphene structure are in the zig-armchair configuration.

17. The modular floating deck structure as specified in claim 10 wherein at least 40 percent of the carbon-carbon bonds on the edges of the graphene structure are in the zig-bay configuration.

18. The modular floating deck structure as specified in claim 10 wherein less than 40 percent of the carbon-carbon bonds on the edges of the graphene structure are in the cove configuration and wherein less than 30 percent of the carbon-carbon bonds on the edges of the graphene structure are in the fjord configuration.

19. The modular floating deck structure as specified in claim 10 wherein the deck section includes a male section connector and a female section connector.

20. The modular floating deck structure as specified in claim 10 wherein the deck is comprised of a plurality of plastic boards which are comprised of polyethylene.

* * * * *